US006558569B1

(12) United States Patent
Shannon et al.

(10) Patent No.: US 6,558,569 B1
(45) Date of Patent: May 6, 2003

(54) LOW VISCOSITY FUNCTIONAL FLUIDS COMPOSITIONS

(75) Inventors: Tammy Tyler Shannon, Winfield, WV (US); Brian Terry Keen, Charleston, WV (US); James Leonard Hansen, Hurricane, WV (US); Pearl Lesley Crossen, Cleveland (GB)

(73) Assignee: Union Carbide Chemicals & Plastics Technology Corporation, Danbury, CT (US)

( * ) Notice: Subject to any disclaimer, the term of this patent is extended or adjusted under 35 U.S.C. 154(b) by 243 days.

(21) Appl. No.: 09/711,051

(22) Filed: Nov. 10, 2000

(51) Int. Cl.[7] ..... C09K 3/18

(52) U.S. Cl. ..... 252/78.1; 252/73; 252/72; 252/75; 252/71; 508/279; 508/280; 508/283

(58) Field of Search ..... 252/78.1, 73, 77, 252/75, 71; 508/279, 280, 283

(56) References Cited

U.S. PATENT DOCUMENTS

| | | | | |
|---|---|---|---|---|
| 3,625,899 | A | 12/1971 | Sawyer | 252/75 |
| 3,711,410 | A | 1/1973 | Sawyer et al. | 252/78 |
| 4,116,846 | A | 9/1978 | Sato et al. | 252/78.1 |
| 4,371,448 | A | 2/1983 | Knoblauch et al. | 252/78.1 |
| 6,074,992 | A | 6/2000 | Levesque | 508/279 |

FOREIGN PATENT DOCUMENTS

| | | |
|---|---|---|
| EP | 0617116 B1 | 12/1999 |
| EP | 0750033 B1 | 3/2000 |
| GB | 1413296 | 11/1972 |

OTHER PUBLICATIONS

Database WPI, Section Ch, Week 199746, Class A97, AN 1997–501400, XP–002194608 & RU 2,078,121 Demidov et al., Apr. 27, 1997 abstract.

*Primary Examiner*—Yogendra N. Gupta
*Assistant Examiner*—D G Hamlin

(57) ABSTRACT

Low viscosity functional fluid compositions particularly useful as brake fluids in anti-lock brake systems comprising a borate ester component, an alkoxy glycol component and an additive package which includes a corrosion inhibitor.

14 Claims, No Drawings

LOW VISCOSITY FUNCTIONAL FLUIDS COMPOSITIONS

FIELD OF THE INVENTION

This invention relates to low viscosity functional fluids which are useful in a variety of applications and in particular as brake fluids for new anti-lock brake systems which require lower viscosity fluids for satisfactory operation at low temperatures.

BACKGROUND OF THE INVENTION

Functional fluid compositions based on borate esters are well known in the art. To be useful as DOT 4 or DOT 5.1 brake fluids, these borate ester based compositions must meet stringent physical property and performance requirements particularly with respect to minimum dry equilibrium reflux boiling point (ERBP), minimum wet equilibrium boiling point (WERBP) and maximum low temperature (−40° C.) viscosity while maintaining adequate resistance to corrosion, stability and meeting other physical property requirements such as pH, reserve alkalinity, rubber swell, etc. The minimum ERBP, WERBP and maximum viscosity requirements, as defined in Federal Motor Vehicle Standards 116, are set forth in the following Table 1:

TABLE 1

| | DOT 4 | DOT 5.1 |
|---|---|---|
| ERBP ° C. | 230 | 260 |
| WERBP ° C. | 155 | 180 |
| −40° C. viscosity cSt | 1800 | 900 |

Recently developed equipment such as electronic or automated anti-lock braking systems has created a need for high performance brake fluids having even better physical and performance properties than those specified in Table 1. In particular, there is a strong demand for high performance brake fluids having low temperature viscosities which are considerably less than those specified in Table 1 while meeting or exceeding the minimum ERBP and WERBP temperature requirements. High performance brake fluids having low temperature viscosities below about 700 centistokes for a DOT 5.1 fluid and below about 500 centistokes for a DOT 4 fluid are being sought for use in these recently developed brake systems.

The ability to formulate borate ester based brake fluids having low temperature viscosity below about 700 centistokes and even lower for DOT 4 fluids while maintaining sufficiently high ERBP and WERBP temperatures has proven to be a difficult challenge for the industry. Sufficient borate ester must be present in the fluid to provide the desired high ERBP and WERBP temperatures. However, larger amounts of borate esters in the fluid composition tends to raise the low temperature viscosity beyond acceptable levels. In addition, many conventional brake fluid additives such as alkanol amine corrosion inhibitors tend to raise the low temperature viscosity of the fluid especially at levels required to maintain pH stability of the fluid. Thus brake fluid compositions having very low viscosity are still being sought.

The prior art discloses a variety of efforts to lower the viscosity of borate ester based brake fluids while maintaining sufficiently high ERBP and WERBP temperatures. For example, U.S. Pat. No. 4,371,448 discloses a borate ester based brake fluid containing a significant amount of a bis(ethylene glycol monoalkyl ether) as an essential component. EP 0 750 033 and EP 0 617 116 disclose attempts to lower the viscosity of borate ester based brake fluids by substituting a complex compound or mixture of compounds for conventional corrosion inhibitors. All of these efforts involve introducing complex and expensive ingredients into the brake fluid while failing to achieve applicant's objective of reducing the low temperature viscosity of the borate ester based brake fluid below 700 centistokes for a fluid otherwise meeting DOT 5.1 specifications and below about 500 centistokes for a fluid otherwise meeting DOT 4 specifications.

SUMMARY OF THE INVENTION

According to the present invention, applicants have discovered some unique combinations of compositions having sufficiently high ERBP and WERBP temperatures to meet or exceed requirements of DOT 4 and 5.1 fluids and a low temperature viscosity (−40° C.) below about 700 centistokes for DOT 4 and 5.1 fluids and preferably below about 500 centistokes for DOT 4 fluids. The novel functional fluid compositions of the present invention are prepared from readily available, inexpensive components and comprise a specifically defined borate ester component, a specifically defined alkoxy glycol component and one of a number of typical additive packages.

DESCRIPTION OF THE INVENTION

The novel low viscosity functional fluids of the present invention comprise (a) from 35 to 70 percent by weight, based on the weight of the total composition, of an alkoxy glycol borate ester component having the formula $$[RO(CH_2CH_2O)_n]_3—B$$

wherein R is methyl, ethyl, propyl or butyl, or mixtures thereof, n is essentially 2 to 4, and wherein borate ester in which n=3 is greater than about 90 percent by weight, based on the total weight of the borate ester component, (b) from about 25 to about 65 percent by weight, based on the total weight of the composition of an alkoxy glycol component having the formula $$RO(CH_2CH_2O)_nH$$

wherein R is an alkyl group containing 1 to 8 carbon atoms or mixtures thereof, n is essentially 2 to 4, alkoxy glycol in which n=2 is present in an amount of from about 1 to about 88 percent by weight, based on the total weight of the alkoxy glycol component, alkoxy glycol in which n=4 is present in an amount of from about 0 to about 20 percent by weight, based on the total weight of the alkoxy glycol component, and (c) from 0.3 to about 10 percent by weight, based on the total weight of the composition of an additive package which contains one or more of the following: corrosion inhibitor, antifoaming agent, pH stabilizer and antioxidant, wherein the total of components (a) and (b) in which n=2 is from about 1 to about 45 percent by weight, based on the total weight of the composition and the total of components (a) and (b) in which n=4 is from about 0 to about 10 percent by weight, based on the total weight of the composition.

Fluid compositions of the present invention having an ERBP of at least 240° C., a WERBP of at least 165° C. and a low temperature viscosity of less than 500 centistokes are obtained when in component (a) n=3 is greater than 90 percent by weight, in component (b) n=2 is from about 12 to 88 percent by weight and n=4 is from about 0 to 10 percent by weight, the total of components (a) and (b) in which n=2 is from about 8 to 45 percent by weight and the total of components (a) and (b) in which n=4 is from about 0 to 6 percent by weight.

Fluid compositions of the present invention having an ERBP of at least 260° C., a WERBP of at least 180° C. and a low temperature viscosity of less than 700 centistokes are obtained when in component (a) n=3 is greater than 95 percent by weight, in component (b) n=2 is from about 1 to 12 percent by weight and n=4 is from about 0 to 20 percent by weight, the total of components (a) and (b) in which n=2 is from about 1 to 8 percent by weight and the total of components (a) and (b) in which n=4 is from about 0 to 10 percent by weight.

Component (a) of the functional fluid compositions of the present invention are alkoxy glycol borate esters represented by the formula $$[RO(CH_2CH_2O)_n]_3—B$$

wherein R is methyl, ethyl, propyl or butyl, or mixtures thereof, n is essentially 2 to 4, and wherein borate ester in which n=3 is greater than about 90 percent by weight, based on the total weight of the borate ester component. Borate esters and their methods of preparation are well known in the art. Borate esters useful in the functional fluid compositions of the present invention may be prepared by reacting boric acid with a suitable alkoxy glycol component which is typically a selective mixture of alkoxy glycols containing at least 90 percent by weight, preferably 95 percent by weight of the alkoxy triethylene glycol species.

Examples of useful borate esters include those containing methoxy triethylene glycol borate ester, ethyl triethylene glycol borate ester, butyl triethylene glycol borate ester and mixtures thereof. Particularly good results have been obtained with a borate ester component containing greater than 90 percent methoxy triethylene glycol borate ester when preparing DOT 4 fluids and greater than 95 percent when preparing DOT 5.1 fluids. Component (a) is typically present in the functional fluid compositions in an amount of from about 35 to about 70 percent by weight, based on the total weight of the composition.

Component (b) of the functional fluid compositions of the present invention comprises from about 25 to 65 percent by weight, based on the total weight of the composition of an alkoxy glycol having the formula $$RO(CH_2CH_2O)_nH$$

wherein R is an alkyl group containing 1 to 8 carbon atoms or mixtures thereof, n is essentially 2 to 4, alkoxy glycol in which n=2 is present in an amount of from about 1 to about 88 percent by weight, based on the total weight of the alkoxy glycol component, and alkoxy glycol in which n=4 is present in an amount of from about 0 to about 20 percent by weight, based on the total weight of the glycol component. Examples of useful alkoxy glycols include methoxy triglycol, methoxy diglycol, methoxy tetraglycol, ethoxy triglycol, ethoxy diglycol, ethoxy tetraglycol, propoxy triglycol, butoxy triglycol, butoxy diglycol, butoxy teteraglycol, pentoxy diglycol, pentoxy triglycol, 2-ethylhexyl diglycol and mixtures thereof Particularly good results have been obtained using an alkoxy glycol component containing methoxy triglycol, methoxy diglycol, ethoxy triglycol, butoxy diglycol, butoxy triglycol, hexoxy diglycol and mixtures thereof Applicants have discovered that alkoxy diglycols in which the alkoxy group contains 1 to 5 carbon atoms are useful in lowering the viscosity of the functional fluid composition. However, when such lower alkoxy diglycols are present in excess of about 45 percent in the DOT 4 fluids of the present invention or in excess of about 8 percent in the DOT 5.1 fluids of the present invention, the ERBP and WERBP may be lowered to unacceptable levels. Higher alkoxy diglycols, i.e. those in which the alkoxy group contains from 5 to 8 carbon atoms, can be tolerated in the functional fluid compositions in amounts up to 10 percent or higher without seriously adversely affecting the ERBP or the WERBP. When present at these levels, these higher alkoxy diglycols have been found to provide advantageous rubber swell properties.

Component (c) of the functional fluid compositions of the present invention comprises from 0.3 to about 10 percent by weight, based on the total weight of the composition of an additive package containing a corrosion inhibitor. A variety of conventional additives which are well known in the art may advantageously be used in the functional fluid compositions of the present invention. These include, for example, corrosion inhibitors, stabilizers such as pH stabilizers and antioxidants.

Choosing an effective corrosion inhibitor is particularly important in formulating the functional fluid compositions of the present invention. Many conventional corrosion inhibitors such as the alkanol amines or alkyl amines and other organic amines increase low temperature viscosity of borate ester based functional fluids leading to the use of more complex and expensive additives such as disclosed in EP 0 750 033 and EP 0 617 116. An advantage of applicant's functional fluid compositions is the ability to use conventional corrosion inhibitors such as the alkanol amines and still achieve lower viscosity than heretofore known. Another advantage is the ability to use increased amounts of conventional inhibitors and additives where desirable to achieve improved stability or corrosion resistance while maintaining an acceptably low viscosity.

Examples of classes of conventional corrosion inhibitors which may be used in the functional fluid compositions of the present invention include fatty acids such as lauric, palmitic, stearic or oleic acids, esters of phosphorus or phosphoric acid with aliphatic alcohols phosphites such as ethyl phosphate, dimethyl phosphate, isopropyl phosphate, butyl phosphite, triphenyl phosphite and di isopropyl phosphite, heterocyclic nitrogen containing compounds such as benzotriazole or its derivatives and mixtures of such compounds with 1,2,4 triazole and its derivatives (see U.S. Pat. No. 6,974,992). Other amine compounds useful as corrosion inhibitors include alkyl amines such as di n-butylamine and di n-amylamine, cyclohexylamine and salts thereof. Amine compounds which are particularly useful as corrosion inhibitors in the functional fluid compositions of the present invention include the alkanol amines, preferably those containing one to three alkanol groups with each alkanol group containing from one to six carbon atoms. Examples of useful alkanol amines include mono-, di- and and trimethanolamine, mono-, di- and triethanolamine, mono-, di- and tripropanolamine and mono-, di- and triisopropanolamine. Good results have been obtained with the functional fluid compositions of the present invention using diisopropanolamine which is readily available and inexpensive.

The amount of corrosion inhibitors used in the functional fluids compositions of the present invention ranges from about 0.3 to about 10 percent by weight, based on the total weight of the composition, preferable from about 1 to about 3 percent.

The functional fluids of the present invention may also advantageously contain, in addition to one or more corrosion inhibitors, other additive compounds such as antifoaming agents, pH stabilizers, antioxidants and the like, all well known to the skilled formulator for enhancing the performance of the functional fluid composition. Such other additives in combination with the corrosion inhibitors are normally present in an amount of from about 0.3 to about 10.0 percent by weight, based on the total weight of the functional fluid composition.

It is contemplated that other materials may be formulated into the functional fluids of the present invention so long as care is taken not to lower the ERBP or WERBP temperatures below acceptable levels or to increase the low temperature viscosity above an acceptable level. For example, the functional fluids of the present invention may include from about 0 to about 20 percent by weight, based on the total weight of the fluid, of a diluent or a lubricant such as, for example, polyethylene oxides, polypropylene oxides, poly(alkylene oxides) dialkoxyglycols or borate co-esters.

It is also contemplated that the teachings of the present invention could be applied to other fluids formulated to achieve lower viscosities such as those disclosed in U.S. Pat. No. 4,371,448, EP 0 750 033 and EP 0 617 116 to further lower viscosity while maintaining acceptable minimum ERBP and WERBP temperatures.

EXAMPLES

The following examples, which are not intended to be limiting, illustrate the functional fluid compositions of the present invention and certain preferred embodiments thereof.

The pure methoxy triethylene glycol borate ester (MTGBE) used to prepare the function fluids in the following examples is a highly selective ester represented by the formula shown above in the discussion of Component (a) and contains 98 percent by weight of the n=3 species and 2 percent of the n=2 species. The MTGBE used in formulating the functional fluids of the following examples was introduced as an 87 percent by weight solution of the pure borate ester in methoxy triethylene glycol.

The borate ester and the various other components used-in formulating the functional fluids in the examples that follow are identified as follows:

| Compound | Chemical Name | [n = 2/3/4/5](a) |
|---|---|---|
| MTGBE | Methoxy triethyene glycol borate ester | (2/98/0/0) |
| MTG | Methoxy triethylene glycol | (2/98/0/0) |
| MPG | Methoxy poly(ethylene glycol) | (2/38/56/4) |
| EDG | Ethoxy diglycol | (100/0/0/0) |
| ETG | Ethoxy triethylene glycol | (1/93/6/0) |
| BDG | Butoxy diglycol | (100/0/0/0) |
| BTG1 | Butoxy triethylene glycol | (3/91/6/0) |
| BTG2 | Butoxy triethylene glycol | (1/78/17/4) |
| BTG3 | Butoxy triethylene glycols | (2/71/24/3) |
| BPG | Butoxy poly(ethylene glycol) | (0/30/65/0) |
| HxDG | Hexoxy diglycol | (100/0/0/0) |
| HPG | Hexoxy poly(ethylene glycol) | (10/70/20/0) |
| MDG | Methoxy diglycol | (100/0/0/0) |
| DIPLA | Diisopropanolamine | |

(a)Percent by weight of the various species present in each alkoxy glycol.

ERBP, WERBP and −40° C. viscosity are determined using test procedures described in Department of Transportation FMVSS 116.

Figures presented in the following tables relating to the amount of each component present are given in percent by weight based on the total weight of the fluid composition. Figures relating to the amount of n=2 and n=4 species present in the glycol ethers are given in percent by weight based on the total weight of all glycol ethers present. Figures relating to the amount of n=2 and n=4 species present in the total fluid composition are given in percent by weight based on the total weight of the fluid composition.

Examples 1 to 5

Five functional fluids were formulated having the composition set forth in Table 2. These examples illustrate functional fluid compositions of the present invention meeting ERBP and WERBP minimum temperature requirements for a DOT 4 brake fluid while having −40° C. viscosity below 700 centistokes. Examples 1 and 2 show fluid compositions having low temperature viscosities below 500 centistokes.

TABLE 2

| Component | Ex. 1 | Ex. 2 | Ex. 3 | Ex. 4 | Ex. 5 |
|---|---|---|---|---|---|
| MTGBE | 50 | 42 | 50 | 56 | 52 |
| MTG | 8 | 19 | 24 | 15 | 18 |
| MPG | 5.4 | | | 4 | |
| BDG | 24 | | | 10 | 13 |
| BTG1 | | 25 | | | |
| BTG2 | | | 24 | | 15 |
| BTG3 | | | | 13 | |
| HxDG | | 8 | | | |
| HPG | | 4 | | | |
| MDG | 10.6 | | | | |
| DIPLA | 2 | 2 | 2 | 2 | 2 |
| n = 2/n = 4 Content | | | | | |
| n = 2 in glycol ether | 71 | 17 | 2 | 25 | 29 |
| n = 4 in glycol ether | 6 | 4 | 8 | 12 | 5 |
| n = 2 in total fluid | 37 | 11 | 2 | 12 | 15 |
| n = 4 in total fluid | 3 | 2 | 4 | 6 | 3 |

The ERBP, WERBP and −40° C. viscosity were determined for the fluid compositions of examples 1 to 5 and are presented in Table 3.

TABLE 3

| Property | Ex. 1 | Ex. 2 | Ex. 3 | Ex. 4 | Ex. 5 |
|---|---|---|---|---|---|
| ERBP° C. | 242 | 264 | 267 | 263 | 261 |
| WERBP° C. | 170 | 173 | 179 | 179 | 169 |
| −40° C. Visc. cSt | 368 | 496 | 611 | 600 | 535 |

As can be seen from Table 3, the fluid compositions of examples 1 and 2 meet the minimum ERBP and WERBP temperature requirements for a DOT 4 fluid and have a low temperature viscosity which is less than the preferred maximum of 500 centistokes.

Examples 6 to 9

Four functional fluids were formulated having the composition set forth in Table 4. Examples 6, 7 and 8 illustrate functional fluid compositions of the present invention meeting ERBP and WERBP minimum temperature requirements for a DOT 5.1 brake fluid while having −40° C. viscosity below 700 centistokes. Example 9 shows a fluid composition which does not meet this viscosity requirement.

TABLE 4

| | Ex. 6 | Ex. 7 | Ex. 8 | Ex. 9 |
|---|---|---|---|---|
| Component | | | | |
| MTGBE | 50 | 52 | 61 | 50 |
| MTG | 18.6 | 13 | 30.5 | 8 |
| MPG | 5.4 | | | 16 |
| ETG | | 15 | 2.5 | |
| BPG | | | | 24 |
| BTG1 | | 10 | 2 | |
| BTG2 | 24 | | | |

TABLE 4-continued

| | Ex. 6 | Ex. 7 | Ex. 8 | Ex. 9 |
|---|---|---|---|---|
| HxDG | | 4 | 2 | |
| HPG | | 4 | | |
| DIPLA | 2 | 2 | 2 | 2 |
| n = 2/n = 4 Content | | | | |
| n = 2 in glycol ether | 2 | 11 | 7 | 1 |
| n = 4 in glycol ether | 15 | 5 | 1 | 51 |
| n = 2 in total fluid | 2 | 6 | 4 | 2 |
| n = 4 in total fluid | 8 | 2 | <1 | 27 |

The ERBP, WERBP and −40° C. viscosity were determined for the fluid compositions of examples 6 to 9 and are presented in Table 5.

TABLE 5

| Property | Ex. 6 | Ex. 7 | Ex. 8 | Ex. 9 |
|---|---|---|---|---|
| ERBP ° C. | 268 | 265 | 265 | 270 |
| WERBP ° C. | 181 | 184 | 186 | 180 |
| −40° C. Visc. cSt | 686 | 552 | 681 | 851 |

As can be seen from Table 5, the fluid compositions of examples 6, 7 and 8 meet the minimum ERBP and WERBP temperature requirements for a DOT 5.1 fluid while also meeting the maximum low temperature viscosity target of 700 centistokes. Example 9 failed to meet this low temperature viscosity target.

The fluid compositions of examples 1, 6 and 7 were selected for testing corrosion resistance and rubber swell using the procedures described in Department of Transportation FMVSS 116. The rubber swell tests were conducted at 170° C. for 72 hours. The results are presented in Table 6.

TABLE 6

| | Ex. 1 | Ex. 6 | Ex. 7 |
|---|---|---|---|
| Corrosion | | | |
| Tin, mg/cm2 | 0.02 | 0.00 | 0.02 |
| Steel, mg/cm2 | −0.01 | −0.01 | −0.02 |
| Aluminum, mg/cm2 | −0.01 | −0.01 | 0.02 |
| Cast iron, mg/cm2 | −0.02 | 0.06 | −0.08 |
| Brass, mg/cm2 | −0.12 | −0.07 | 0.03 |
| Copper, mg/cm2 | −0.10 | −0.09 | 0.01 |
| Zinc, mg/cm2 | 0.00 | 0.08 | 0.11 |
| Cup base diam., mm | 0.299 | 0.306 | 0.064 |
| Hardness decrease, IRHD 6.0 | | 3.0 | 1.3 |
| Rubber Swell | | | |
| Base diameter, mm | 1.4 | 1.1 | 0.7 |
| Hardness decrease, IRHD 9.5 | | 10.5 | 5.7 |

What is claimed is:

1. A functional fluid composition comprising (a) from 35 to 70 percent by weight, based on the weight of the total composition, of an alkoxy glycol borate ester having the formula $$[RO(CH_2CH_2O)_n]_3—B$$

wherein R is methyl, ethyl, propyl or butyl, or mixtures thereof, n is essentially 2 to 4, and n=3 is greater than about 90 percent by weight, based on the total weight of the borate ester component, (b) from about 25 to about 65 percent by weight, based on the total weight of the composition of an alkoxy glycol component having the formula $$RO(CH_2CH_2O)_nH$$

wherein R is an alkyl group containing 1 to 8 carbon atoms or mixtures thereof, n is essentially 2 to 4, alkoxy glycol in which n=2 is present in an amount of from about 1 to about 88 percent by weight, based on the total weight of the alkoxy glycol component, alkoxy glycol in which n=4 is present in an amount of from about 0 to about 20 percent by weight, based on the total weight of the alkoxy glycol component, and (c) from 0.3 to about 10 percent by weight, based on the total weight of the composition of an additive package containing corrosion inhibitors, wherein the total of components (a) and (b) in which n=2 is from about 1 to about 45 percent by weight, based on the total weight of the composition and the total of components (a) and (b) in which n=4 is from about 0 to about 10 percent by weight, based on the total weight of the composition.

2. A composition of claim 1 wherein n=3 in component (a) is greater than 90 percent, n=2 in component (b) is from about 12 to 88 percent and n=4 in component (b) is from about 0 to 10 percent, the total of components (a) and (b) in which n=2 is from about 8 to 45 percent and the total of components (a) and (b) in which n=4 is from about 0 to 6 percent.

3. A composition of claim 2 having an ERBP of at least 240° C., a WERBP of at least 165° C. and a low temperature viscosity of less than 500 centistokes.

4. A composition of claim 1 wherein n=3 in component (a) is greater than 95 percent, n=2 in component (b) is from about 1 to 12 percent and n=4 is from about 0 to 20 percent, the total of components (a) and (b) in which n=2 is from about 1 to 8 percent and the total of components (a) and (b) in which n=4 is from about 0 to 10 percent.

5. A composition of claim 4 having an ERBP of at least 260° C., a WERBP of at least 180° C. and a low temperature viscosity of less than 700 centistokes.

6. A composition of claim 1 wherein component (a) is predominately methoxy triglycol borate ester.

7. A composition of claim 1 wherein component (b) is predominately methoxy triglycol, ethoxy triglycol, butoxy triglycol or mixtures thereof.

8. A composition of claim 1 wherein component (c) contains one or more additives selected from the group consisting of amines, antioxidants, and inorganic salts.

9. A composition of claim 1 wherein component (c) contains from 0.5 to 5 percent by weight, based on the total weight of the composition, of an organic amine.

10. A composition of claim 7 wherein component (a) is present in an amount of from about 35 to about 55 percent by weight, based on the total weight of the composition, component (b) is present in an amount of from about 40 to about 65 percent.

11. A composition of claim 1 wherein component (a) is present in an amount of from about 45 to about 70 percent by weight, based on the total weight of the composition, component (b) is present in an amount of from about 25 to about 50 percent.

12. A composition of claim 1 wherein component (b) contains at least about one percent by weight, based on the total weight of the composition, of hexoxy diglycol.

13. A brake fluid comprising the composition of claim 1.

14. A combination of an electronic or automated anti-lock brake system and a brake fluid comprising the composition of claim 1.

* * * * *